US010050321B2

(12) United States Patent
Rogozine et al.

(10) Patent No.: US 10,050,321 B2
(45) Date of Patent: Aug. 14, 2018

(54) DIELECTRIC WAVEGUIDE FILTER WITH DIRECT COUPLING AND ALTERNATIVE CROSS-COUPLING

(71) Applicant: CTS Corporation, Elkhart, IN (US)

(72) Inventors: Alexandre Rogozine, Rio Rancho, NM (US); Reddy Vangala, Albuquerque, NM (US)

(73) Assignee: CTS Corporation, Lisle, IL (US)

( * ) Notice: Subject to any disclaimer, the term of this patent is extended or adjusted under 35 U.S.C. 154(b) by 48 days.

(21) Appl. No.: 15/152,325

(22) Filed: May 11, 2016

(65) Prior Publication Data

US 2016/0336632 A1 Nov. 17, 2016

Related U.S. Application Data

(63) Continuation-in-part of application No. 14/708,870, filed on May 11, 2015, now Pat. No. 9,437,908,
(Continued)

(51) Int. Cl.
*H01P 1/20* (2006.01)
*H01P 7/10* (2006.01)
(Continued)

(52) U.S. Cl.
CPC ..... *H01P 1/2002* (2013.01); *H01P 1/10* (2013.01); *H01P 1/207* (2013.01); *H01P 1/208* (2013.01); *H01P 1/2088* (2013.01)

(58) Field of Classification Search
CPC ..... H01P 1/2002; H01P 7/10; H01P 1/208; H01P 1/2088
(Continued)

(56) References Cited

U.S. PATENT DOCUMENTS 3,882,434 A 5/1975 Levy
3,955,161 A 5/1976 MacTurk
(Continued)

FOREIGN PATENT DOCUMENTS

CN 201898182 U 7/2011
CN 102361113 A 2/2012
(Continued)

OTHER PUBLICATIONS

Ruiz-Cruz J et al: "Rectangular Waveguide Elliptic Filters with Capacitive and Inductive Irises and Integrated Coaxial Excitation", 2005 IEEE MTT-S International Micorwave Symposium, Piscataway, NJ, USA, IEEE, (Jun. 12, 2005) pp. 269-272, EP010844740, DOI: 10.1109/MWSYM.2005,1516577, ISBN: 978-0-7803-8846-8 p. 269; figures 1,3.
(Continued)

*Primary Examiner* — Rakesh Patel
(74) *Attorney, Agent, or Firm* — Daniel Deneufbourg

(57) ABSTRACT

A waveguide filter for the transmission of an RF signal comprising a plurality of blocks of dielectric material coupled together in a combined side-by-side and stacked relationship. Each of the blocks defines resonators and includes an exterior surface that is covered with a layer of conductive material and defines internal layers of conductive material with the blocks coupled together. The internal layers of conductive material include regions devoid of conductive material that define internal windows for the transmission of the RF signal between resonators in the side-by-side and stacked blocks. The internal layers of conductive material also include regions devoid of conductive material that define isolated pads of conductive material for the indirect transmission of the RF signal between resonators in the stacked blocks.

10 Claims, 3 Drawing Sheets

Related U.S. Application Data which is a continuation-in-part of application No. 14/842,920, filed on Sep. 2, 2015, now Pat. No. 9,431,690.

(60) Provisional application No. 62/165,657, filed on May 22, 2015.

(51) Int. Cl.
*H01P 1/10* (2006.01)
*H01P 1/207* (2006.01)
*H01P 1/208* (2006.01)

(58) Field of Classification Search
USPC ..... 333/202, 208–212, 219.1
See application file for complete search history.

(56) References Cited

U.S. PATENT DOCUMENTS 4,396,896 A 8/1983 Williams
4,431,977 A 2/1984 Sokola et al.
4,609,892 A 9/1986 Higgins, Jr.
4,644,343 A * 2/1987 Schneider ..... H01Q 21/0043 343/767
4,692,726 A 9/1987 Green et al.
4,706,051 A 11/1987 Dieleman et al.
4,773,208 A 3/1988 Ishikawa et al.
4,742,562 A 5/1988 Kommrusch
4,800,348 A 1/1989 Rosar et al.
4,806,889 A 2/1989 Nakano et al.
4,837,535 A 6/1989 Konishi et al.
4,940,955 A 7/1990 Higgins, Jr.
4,963,844 A 10/1990 Konishi et al.
4,996,506 A 2/1991 Ishikawa et al.
5,004,992 A 4/1991 Grieco et al.
5,023,944 A 6/1991 Bradley
5,130,682 A 7/1992 Agahi-Kesheh
5,208,565 A 5/1993 Sogo et al.
5,243,309 A 9/1993 L'Ecuyer
5,288,351 A 2/1994 Hoang et al.
5,285,570 A 5/1994 Fulinara
5,365,203 A 11/1994 Nakamura et al.
5,382,931 A 1/1995 Piloto et al.
5,416,454 A 5/1995 McVetty
5,525,946 A 6/1996 Tsujiguchi et al.
5,528,204 A 6/1996 Hoang et al.
5,528,207 A 6/1996 Ito
5,537,082 A 7/1996 Tada et al.
5,572,175 A 11/1996 Tada et al.
5,602,518 A 2/1997 Clifford, Jr. et al.
5,719,539 A 2/1998 Ishizaki et al.
5,731,751 A 3/1998 Vangala
5,821,836 A 10/1998 Katehi et al.
5,850,168 A 12/1998 McVetty et al.
5,926,078 A 7/1999 Hino et al.
5,926,079 A 7/1999 Heine et al.
5,929,726 A 7/1999 Ito et al.
5,999,070 A 12/1999 Endo
6,002,306 A 12/1999 Arakawa et al.
6,016,091 A 1/2000 Hidaka et al.
6,023,207 A 2/2000 Ito et al.
6,026,281 A 2/2000 Yorita
6,137,383 A 10/2000 De Lillo
6,154,106 A 11/2000 De Lillo
6,160,463 A 12/2000 Arakawa et al.
6,181,225 B1 1/2001 Bettner
6,255,921 B1 7/2001 Arakawa et al.
6,281,764 B1 8/2001 Arakawa et al.
6,329,890 B1 12/2001 Brooks et al.
6,351,198 B1 2/2002 Tsukamoto et al.
6,437,655 B1 8/2002 Andoh et al.
6,504,446 B1 1/2003 Ishihara et al.
6,535,083 B1 3/2003 Hageman et al.
6,549,095 B2 5/2003 Tsukamoto et al.
6,559,740 B1 5/2003 Schulz et al.
6,568,067 B2 5/2003 Takeda
6,594,425 B2 7/2003 Tapalian et al.
6,677,837 B2 1/2004 Kojima et al.
6,757,963 B2 7/2004 Meier et al.
6,791,403 B1 9/2004 Tayrani et al.
6,801,106 B2 10/2004 Ono et al.
6,834,429 B2 12/2004 Blair et al.
6,844,861 B2 1/2005 Peterson
6,888,973 B2 5/2005 Kolodziejski et al.
6,900,150 B2 5/2005 Jacquin et al.
6,909,339 B2 6/2005 Yonekura et al.
6,909,345 B1 6/2005 Salmela et al.
6,927,653 B2 8/2005 Uchimura et al.
6,977,560 B2 12/2005 Iroh et al.
6,977,566 B2 12/2005 Fukunaga
7,009,470 B2 3/2006 Yatabe et al.
7,068,127 B2 6/2006 Wilber et al.
7,132,905 B2 11/2006 Sano
7,142,074 B2 11/2006 Kim et al.
7,170,373 B2 1/2007 Ito et al.
7,271,686 B2 9/2007 Yoshikawa et al.
7,323,954 B2 1/2008 Lee et al.
7,449,979 B2 11/2008 Koh et al.
7,545,235 B2 6/2009 Mansour et al.
7,659,799 B2 2/2010 Jun et al.
7,714,680 B2 5/2010 Vangala et al.
8,008,993 B2 8/2011 Milson et al.
8,072,294 B2 12/2011 Tanpo et al.
8,171,617 B2 5/2012 Vangala
8,284,000 B2 10/2012 Fukunaga
8,314,667 B2 11/2012 Uhm et al.
8,823,470 B2 9/2014 Vangala
9,030,279 B2 5/2015 Vangala
9,130,255 B2 9/2015 Rogozine et al.
9,130,256 B2 9/2015 Rogozine et al.
9,130,257 B2 9/2015 Vangala
9,130,258 B2 9/2015 Vangala et al.
2001/0024147 A1 9/2001 Arkawa et al.
2002/0024410 A1 2/2002 Guglielmi et al.
2003/0006865 A1 1/2003 Kim et al.
2004/0000968 A1 1/2004 White et al.
2004/0056737 A1 3/2004 Carpintero et al.
2004/0129958 A1 7/2004 Kho et al.
2004/0257194 A1 12/2004 Casey et al.
2005/0057402 A1 3/2005 Ohno et al.
2007/0120628 A1 5/2007 Jun et al.
2009/0015352 A1 1/2009 Goebel et al.
2009/0102582 A1 4/2009 Van Der Heijden et al.
2009/0146761 A1 6/2009 Nummerdor
2009/0201106 A1 8/2009 Iio et al.
2009/0231064 A1 9/2009 Bates et al.
2010/0024973 A1 2/2010 Vangala
2010/0253450 A1 10/2010 Kim et al.
2011/0032050 A1 2/2011 Kouki et al.
2011/0279200 A1 11/2011 Vangala
2012/0229233 A1 9/2012 Ito
2012/0286901 A1 11/2012 Vangala
2013/0214878 A1 8/2013 Gorisee et al.
2014/0077900 A1 3/2014 Rogozine et al.
2014/0266514 A1 9/2014 Rogozine et al.
2015/0084720 A1 3/2015 Vangala et al.
2015/0295294 A1 10/2015 Rogozine et al.

FOREIGN PATENT DOCUMENTS

DE 102008017967 A1 10/2009
EP 0322993 A2 7/1989
EP 0322993 A3 4/1990
EP 0444948 A2 3/1991
EP 0757401 A2 2/1997
EP 0859423 A1 8/1998
EP 1024548 A1 2/2000
EP 0997964 A2 5/2000
EP 0997964 A3 9/2001
EP 1439599 A1 7/2004
FR 2318512 A1 2/1977
JP 62038601 2/1987
JP 1998009331 A 1/1998
JP 2003298313 10/2003

(56) References Cited

FOREIGN PATENT DOCUMENTS

| | | | |
|---|---|---|---|
| JP | 2006157486 | | 6/2006 |
| JP | 201028381 | A | 2/2010 |
| JP | 2012191474 | A | 10/2012 |
| JP | 2013143734 | A | 7/2013 |
| WO | 199509451 | | 4/1995 |
| WO | 2000024080 | | 4/2000 |
| WO | 0038270 | A1 | 6/2000 |
| WO | 05091427 | | 9/2005 |

OTHER PUBLICATIONS

Paul Wade: "Rectangular Waveguide to Coax Transition Design", QEX, Nov./Dec. 2006, pp. 10-17, published by American Radio Relay League, Newington, Connecticut, US.

Yoji Isota, Moriyasu Miyazaki, Osami Ishida, Fumio Takeda, Mitsubishi Electric Corporation. "A Grooved Monoblock Comb-Line Filter Suppressing the Third Harmonics", IEEE 1987 MTT-S Digest, pp. 383-386, published by IEEE, New York, New York, US.

D. Choi, Fig. 2.13, Monolithic Plated Ceramic Waveguide Filters, Mar. 31, 1986, Motorola, Inc., Schaumburg, Illinois, U.S.

Kocbach J. et al: "Design Procedure for Waveguide Filters with Cross-Couplings", 2002 IEEE MTT-S International Microwave Symposium Digest (Cat. No. 02CH37278) IEEE Piscataway, NJ, USA; IEEE MTT-S International Microwave Symposium, IEEE, Jun. 2, 2002, pp. 1449-1452, XP001113877, DOI: 10.1109/WMSYM.2002.1012128 ISBN: 978-0-8703-7239-9 abstract; figure 1.

N. Marcuvitz, Waveguide Handbook, McGraw-Hill Book Co., New York City, Ch. 5, 1951.

Y. Konishi, "Novel dielectric waveguide components-microwave applications of new ceramic materials," Proc. IEEE, vo. 79, pp. 726-740, Jun. 1991.

K. Sano, "Dielectric waveguide filter with low profile and low insertion loss," IEEE Trans. on Microwave Theory & Tech., vol. 47, pp. 2299-2303, Dec. 1999.

K. Sano and T. Yoneyama, "A transition from Microstrip to Dielectric Filled Rectangular Waveguide in Surface Mounting," IEEE MTT-S Int. Microwave Symp. Digest, pp. 813-816, 2002.

I. Awai, A.C. Kundu, and T. Yamashita, "Equivalent circuit representation and explanation of attenuation poles of a dual-mode dielectric resonator bandpass filter," IEEE Trans. Microwave Theory & Tech., vol. 46, pp. 2159-2163, Dec. 1998.

A.D. Paidus and C. Rossiter, "Cross-coupling in microwave bandpass filters," Microwave Journal, pp. 22-46, Nov. 2004.

Tze-min Shen; Chi-Feng Chen' Huang, Ting-Yi; Wu, Ruey-Beei, "Design of Vertically Stacked Waveguide Filters in LTCC," Microwave Theory and Techniques, IEEE Transactions on, vol. 55, No. 8, pp. 1771,1779, Aug. 2007.

Hung-Yi Chien; Tze-Min Shen; Huang; Ting-Yi; Wei-Hsin Wang; Wu, Ruey-Beei, "Miniaturized Bandpass Filters with Double-Folded Substrate Integrated Resonators in LTCC," Microwave Theory and Techniques, IEEE Transactions on vol. 57, No. 7, pp. 1774, 1782, Jul. 2009.

Bo-Jiun Chen; Tze-Min Shen; Wu, Ruey-Beei, "Dual Band Vertically Stacked Laminated Waveguide Filter Design in LTCC Technology," Microwave Theory and Techniques, IEEE Transactions on, vol. 57, No. 6, pp. 1554, 1562, Jun. 2009.

Wolfram Wersing, Microwave ceramics for resonators and filters, Current Opinion in Solid State and Materials Science, vol. 1, Issue 5, Oct. 1996, pp. 715-731, ISSN 1359-0286.

Shen T et al, Full-Wave Design of Canonical Waveguide Filters by Optimation, 2001 IEEE MTT-S International Microwave Symposium Digest. (IMS 2001) Phoenix, AZ, May 20-25, 2001, pp. 1487-1490.

John David Rhodes, The Generalized Direct-Coupled Cavity Linear Phase Filter, IEEE Transactions on Microwave Theory and Techniques, vol. MTT-18, No. 6, Jun. 1, 1970 (Jun. 1, 1970), pp. 308-3113, XP001401320, abstract.

Y. Cassivi et al, Low-Cost and High-Q Millimeter-Wave Resonator Using Substrate Integrated Waveguide Technique, Microwave Conference, 2002. 32nd European, pp. 1-4.

Emilio Amieri et al, Coaxially Fed Substrate Integrated Radiating Waveguides, Antennas and Propagation Society International Symposium, 2007 IEEE, pp. 2718-2721.

* cited by examiner

DIELECTRIC WAVEGUIDE FILTER WITH DIRECT COUPLING AND ALTERNATIVE CROSS-COUPLING

CROSS-REFERENCE TO RELATED AND CO-PENDING APPLICATIONS

This application is a continuation-in-part application that claims the benefit of the filing date and disclosure of U.S. patent application Ser. No. 14/708,870 filed on May 11, 2015 which claims the benefit of the filing date and disclosure of U.S. patent application Ser. No. 13/373,862 filed on Dec. 3, 2011, now U.S. Pat. No. 9,030,279 issued on May 12, 2015, the contents of which are incorporated herein by reference as are all references cited therein.

This application is also a continuation-in-part application that claims the benefit of the filing date and disclosure of U.S. patent application Ser. No. 14/842,920 filed on Sep. 2, 2015 which claims the benefit of the filing date and disclosure of U.S. patent application Ser. No. 14/088,471 filed on Nov. 25, 2013, now U.S. Pat. No. 9,130,255 issued on Sep. 8, 2015, the contents of which are incorporated herein by reference as are all references cited therein.

This application also claims the benefit of the filing date and disclosure of U.S. Provisional Patent Application Ser. No. 62/165,657 filed on May 22, 2015, the contents of which are incorporated herein by reference as are all references cited therein.

FIELD OF THE INVENTION

The invention relates generally to dielectric waveguide filters and, more specifically, to a dielectric ceramic waveguide filter with direct coupling and alternative cross-coupling.

BACKGROUND OF THE INVENTION

This invention is related to a dielectric waveguide filter of the type disclosed in U.S. Pat. No. 5,926,079 to Heine et al. in which a plurality of resonators are spaced longitudinally along the length of a block of dielectric/ceramic material and in which a plurality of slots/notches are spaced longitudinally along the length of the block and define a plurality of RF signal bridges of dielectric material between the plurality of resonators which provide a direct inductive/capacitive coupling between the plurality of resonators.

The attenuation characteristics of a waveguide filter of the type disclosed in U.S. Pat. No. 5,926,079 to Heine et al. can be increased through the incorporation of zeros in the form of additional resonators located at one or both ends of the waveguide filter. A disadvantage associated with the incorporation of additional resonators, however, is that it also increases the length of the filter which, in some applications, may not be desirable or possible due to, for example, space limitations on a customer's motherboard.

The attenuation characteristics of a filter can also be increased by both direct and cross-coupling of the resonators as disclosed in, for example, U.S. Pat. No. 7,714,680 to Vangala et al. which discloses a block filter with both inductive direct coupling and quadruplet cross-coupling of resonators created in part by respective metallization patterns which are defined on the top surface of the filter and extend between selected ones of the resonator through-holes to provide the disclosed direct and cross-coupling of the resonators.

Direct and cross-coupling of the type disclosed in U.S. Pat. No. 7,714,680 to Vangala et al. and comprised of top surface metallization patterns is not applicable in waveguide filters of the type disclosed in U.S. Pat. No. 5,926,079 to Heine et al. which includes only slots and no top surface metallization patterns.

The present invention is thus directed to a dielectric waveguide filter with both direct and optional or alternative cross-coupled resonators which allow for an increase in the attenuation characteristics of the waveguide filter without an increase in the length of the waveguide filter.

SUMMARY OF THE INVENTION

The present invention is generally directed to a waveguide filter for the transmission of an RF signal comprising a plurality of blocks of dielectric material coupled together in a side-by-side and stacked relationship, each of the blocks defining resonators and including an exterior surface covered with a layer of conductive material and defining internal layers of conductive material between the side-by-side and stacked plurality of blocks of dielectric material, first regions in the internal layers of conductive material devoid of conductive material and defining first internal windows for the direct transmission of the RF signal between resonators in the side-by-side and stacked plurality of blocks of dielectric material, and second regions in the internal layers of conductive material devoid of conductive material and defining second internal means for the indirect transmission of the RF signal between resonators in the stacked plurality of blocks of dielectric material.

In one embodiment, the second internal means for the indirect transmission of the RF signal comprise isolated pads of conductive material in the internal layers of conductive material.

The present invention is also directed to a waveguide filter for the transmission of an RF signal comprising a plurality of blocks of dielectric material coupled together in a combined side-by-side and stacked relationship, each of the plurality of blocks of dielectric material including an exterior surface covered with a layer of conductive material and defining a plurality of resonators, a first internal layer of conductive material defined between each of the side-by-side plurality of blocks of dielectric material by the layer of conductive material covering the exterior surface of each of the plurality of blocks of dielectric material, a second internal layer of conductive material defined between each of the stacked plurality of blocks of dielectric material by the layer of conductive material covering the exterior surface of each of the plurality of blocks of dielectric material, an RF signal input defined on a first one of the plurality of blocks of dielectric material, an RF signal output defined on a second one of the plurality of blocks of dielectric material, the RF signal being transmitted through the plurality of resonators in the plurality of blocks of dielectric material between the RF signal input and the RF signal output, internal direct RF signal transmission means defined in selected regions of the first and second internal layers of conductive material for the direct transmission of the RF signal between a resonator in one of the plurality of blocks of dielectric material and a resonator in another of the plurality of blocks of dielectric material, and internal indirect RF signal transmission means defined in selected regions of the first internal layer of conductive material for the indirect transmission of the RF signal between a resonator in one of the plurality of blocks of dielectric material and a resonator in another of the plurality of blocks of dielectric material.

In one embodiment, the internal direct RF signal transmission means is defined by a window in the first and second internal layers of conductive material devoid of conductive material and the internal indirect RF signal transmission means is defined by an isolated pad of conductive material defined in the first internal layer of conductive material.

In one embodiment, the plurality of blocks of dielectric material comprise first and second blocks of dielectric material coupled together in a side-by-side relationship and third and fourth blocks of dielectric material coupled together in a side-by-side relationship, the first and second blocks of dielectric material being coupled to the third and fourth blocks in a stacked relationship, the RF signal input and the RF signal output being defined in the first and second blocks of dielectric material respectively, the internal direct RF signal transmission means defined by a first interior window defined between the first and third blocks of dielectric material, a second interior window defined between the third and fourth blocks of dielectric material, and a third interior window defined between the fourth and second blocks of dielectric material, and the internal indirect RF signal transmission means is defined by a first internal isolated pad of conductive material between the first and third blocks of dielectric material and a second internal isolated pad of conductive material between the second and fourth blocks of dielectric material.

In one embodiment, each of the RF signal input and output is defined by an RF signal transmission through-hole extending through respective first and second ones of the plurality of blocks of dielectric material, and the internal indirect RF signal transmission means is an isolated pad of conductive material in the interior layer of conductive material.

The present invention is still further directed to a waveguide filter for the transmission of an RF signal comprising first and second blocks of dielectric material coupled together in a side-by-side relationship, each of the first and second blocks of dielectric material defining a plurality of resonators and including an exterior surface covered with a layer of conductive material, third and fourth blocks of dielectric material coupled together in a side-by-side relationship, each of the third and fourth blocks of dielectric material defining a plurality of resonators and including an exterior surface covered with a layer of conductive material, the first and second blocks of dielectric material and the third and fourth blocks of dielectric material being coupled relative to each other in a stacked relationship, a first interior layer of conductive material defined between the first and second blocks of dielectric material and the third and fourth blocks of dielectric material by the layer of conductive material covering the first, second, third, and fourth blocks of dielectric material, a second interior layer of conductive material defined between the first and third blocks of dielectric material and the second and fourth blocks of dielectric material by the layer of conductive material covering the first, second, third, and fourth blocks of dielectric material, an RF signal input transmission through-hole defined in the first block of dielectric material, an RF signal output transmission through-hole defined in the second block of dielectric material, the RF signal being transmitted through the plurality of resonators in the first, second, third, and fourth blocks of dielectric material between the RF signal input transmission through-hole and the RF signal output transmission through-hole, a first internal direct RF signal transmission window between the first and third blocks of dielectric material and defined by a first region in the first interior layer of conductive material that is devoid of conductive material for the direct transmission of the RF signal between one of the plurality of resonators in the first block of dielectric material and one of the plurality of resonators in the third block of dielectric material, a second internal direct RF signal transmission window between the second and fourth blocks of dielectric material and defined by a second region in the first interior layer of conductive material that is devoid of conductive material for the direct transmission of the RF signal between one of the plurality of resonators in the fourth block of dielectric material and one of the plurality of resonators in the second block of dielectric material, a third internal direct RF signal transmission window between the third and fourth blocks of dielectric material and defined by a first region in the second interior layer of conductive material for the direct transmission of the RF signal between one of the plurality of resonators in the third block of dielectric material and one of the resonators in the fourth block of dielectric material, a first internal indirect RF signal transmission means between the first and third blocks of dielectric material and defined by a third region in the first interior layer of conductive material that is devoid of conductive material for the indirect transmission of the RF signal between another of the plurality of resonators in the first block of dielectric material and another of the plurality of resonators in the third block of dielectric material, and a second internal indirect RF signal transmission means between the second and fourth blocks of dielectric material and defined by a fourth region in the first interior layer of conductive material that is devoid of conductive material for the indirect transmission of the RF signal between another of the plurality of resonators in the fourth block of dielectric material and another of the plurality of resonators in the second block of dielectric material.

In one embodiment, the first and second internal indirect RF signal transmission means comprise first and second isolated pads of conductive material defined by the third and fourth regions in the first interior layer of conductive material.

In one embodiment, the plurality of resonators in each of the first, second, third, and fourth blocks of dielectric material are separated by a slit and an RF signal transmission bridge.

In one embodiment, the slit defined in the third block of dielectric material faces the slit defined in the fourth block of dielectric material and the slit defined in the first block of dielectric material faces away from the slit defined in the second block of dielectric material.

Other advantages and features of the present invention will be more readily apparent from the following detailed description of the preferred embodiment of the invention, the accompanying drawings, and the appended claims.

BRIEF DESCRIPTION OF THE DRAWINGS

These and other features of the invention can best be understood by the following description of the accompanying FIGURES as follows.

DETAILED DESCRIPTION OF THE EMBODIMENT

Figure 1:
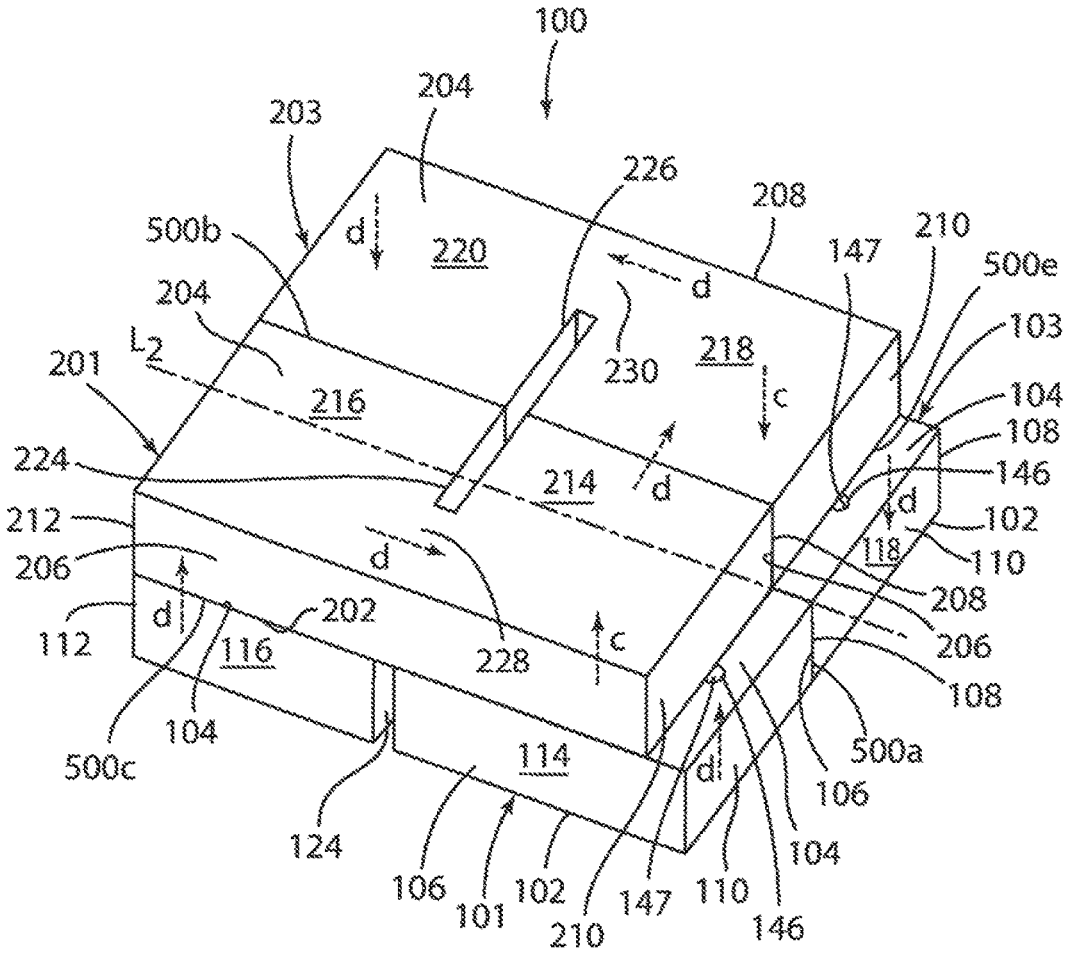
FIG. 1 is an enlarged perspective view of a dielectric waveguide filter according to the present invention.
Figure 2:
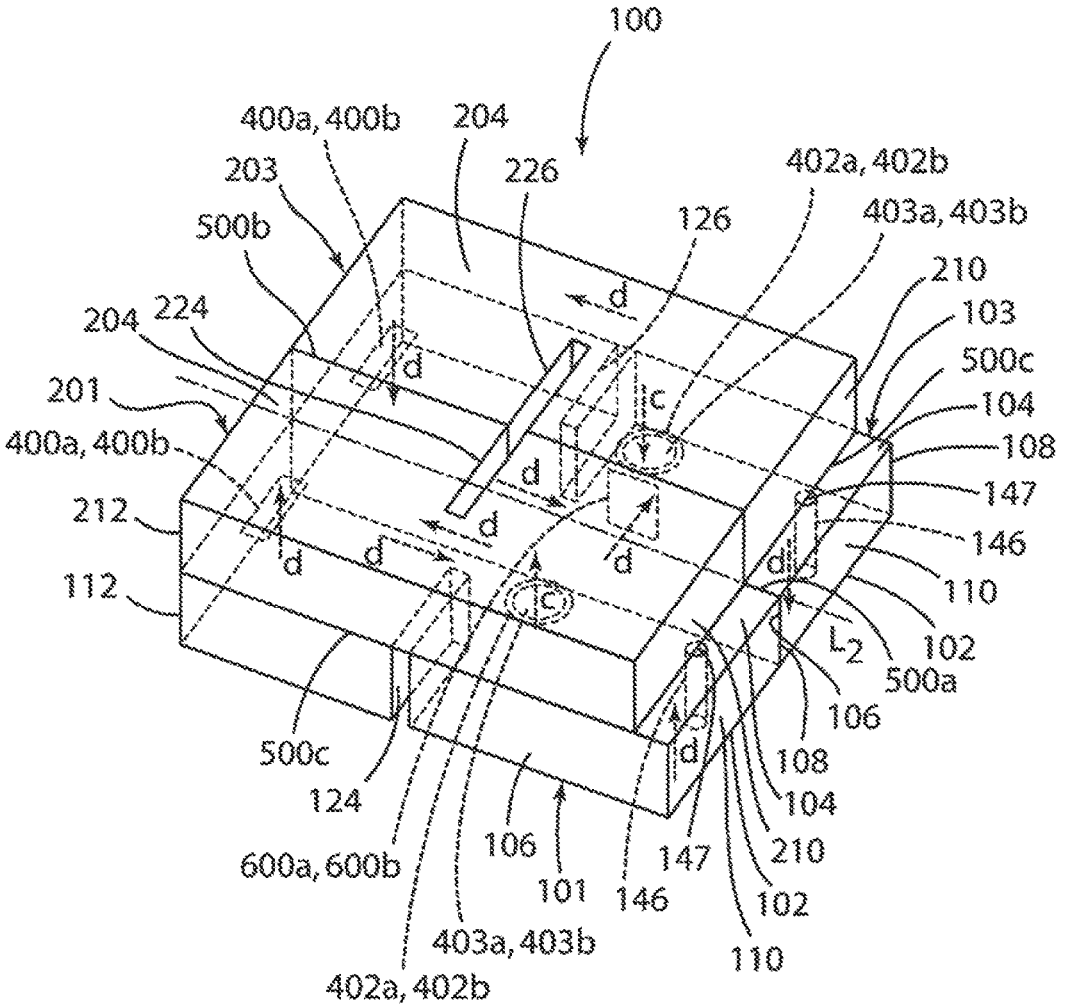
FIG. 2 is an enlarged, part phantom perspective view of the dielectric waveguide filter shown in FIG. 1.
Figure 3:
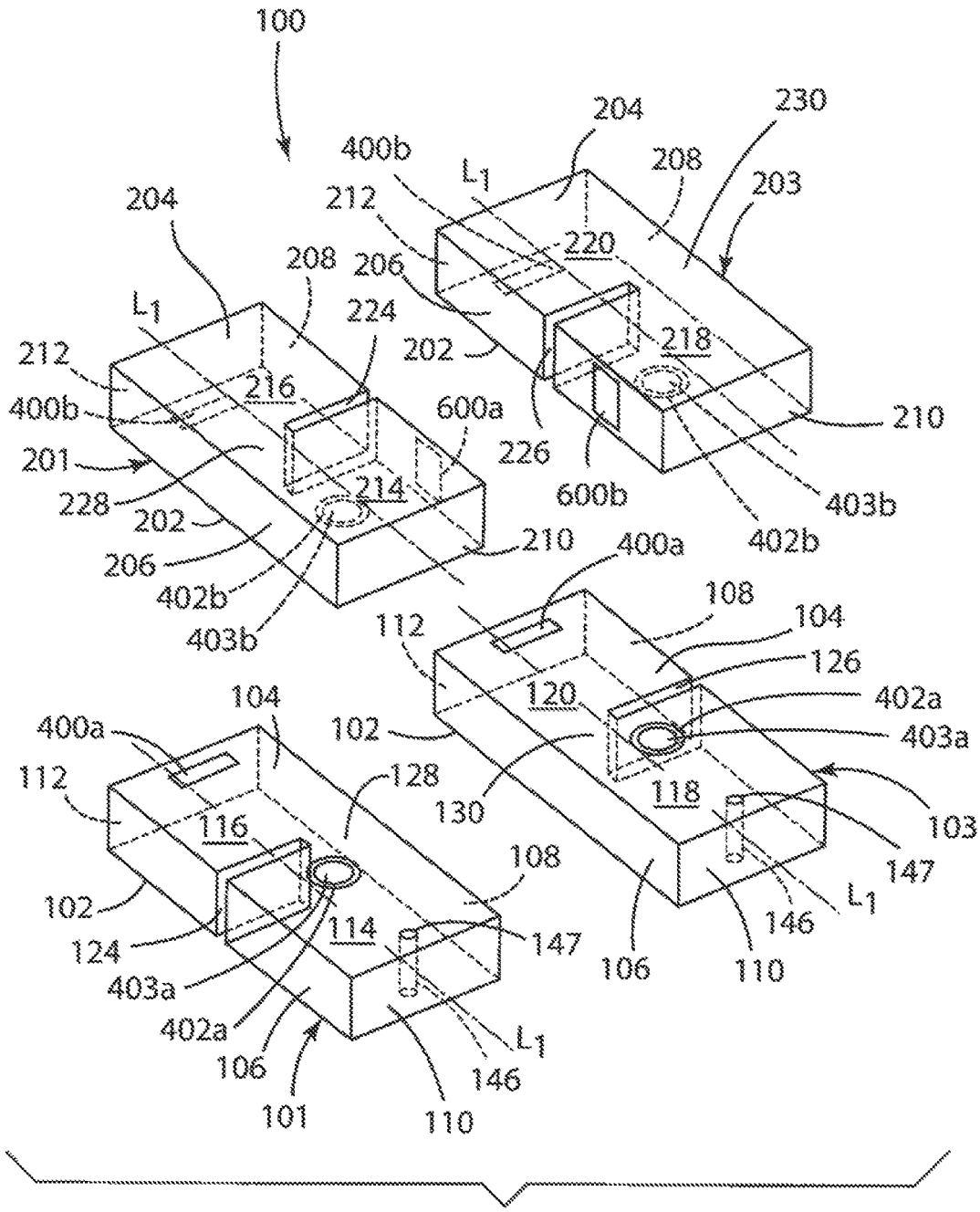
FIG. 3 is an enlarged, part phantom exploded perspective view of each of the separate solid dielectric blocks of the dielectric waveguide filter shown in FIG. 1.

FIGS. 1, 2, and 3 depict a ceramic dielectric waveguide filter 100 in accordance with the present invention which incorporates both direct coupling and alternative cross-coupling features.

In the embodiment shown, the waveguide filter 100 is made from four separate generally parallelepiped-shaped blocks or blocks 101, 103, 201, and 203 of solid dielectric material which have been coupled and secured together in a combination side-by-side and stacked relationship to form the waveguide filter 100 as described in more detail below. Specifically, the bottom blocks 101 and 103 are coupled together in a side-by-side relationship and the top blocks 201 and 203 are coupled together in a side-by-side relationship with the top blocks 201 and 203 stacked on and over the bottom blocks 101 and 103 with the top block 201 stacked on and over the bottom block 101 and the top block 203 stacked on and over the bottom block 103.

Each of the bottom blocks 101 and 103 is comprised of a solid block of suitable dielectric material, such as for example ceramic; defines a longitudinal axis $L_1$; includes opposed longitudinal horizontal exterior bottom and top surfaces 102 and 104 extending longitudinally in the same direction as the longitudinal axis $L_1$; opposed longitudinal side vertical exterior surfaces 106 and 108 extending longitudinally in the same direction as the longitudinal axis $L_1$; and opposed transverse side vertical exterior end surfaces 110 and 112 extending in a direction generally normal to the longitudinal axis $L_1$ of each of the blocks 101 and 103.

Each of the blocks 101 and 103 includes a plurality of resonant sections (also referred to as cavities or cells or resonators) 114, 116 and 118, 120 respectively that are spaced and extend longitudinally along the length and longitudinal axis $L_1$ of the respective blocks 101 and 103 and are separated from each other by respective vertical slits or slots 124 and 126 respectively which are cut into the surfaces 102, 104, 106, and 108 of each of the blocks 101 and 103 and respective RF signal bridges 128 and 130 of dielectric material as described in more detail below.

The slots 124 and 126 extend along the length of the respective side surfaces 106 and 108 of the respective blocks 101 and 103 in a relationship generally normal to the longitudinal axis $L_1$. Each of the slots 124 and 126 cuts through the respective side surfaces 106 and 108 and the opposed horizontal surfaces 102 and 104 and partially through the body and the dielectric material of each of the blocks 101 and 103. The slots 124 and 126 are generally centrally located in the respective blocks 101 and 103 between and in a relationship parallel to the opposed transverse exterior end surfaces 110 and 112.

In the embodiment shown, the slots 124 and 126 do not extend the full width of the respective blocks 101 and 103 and thus the blocks 101 and 103 define respective generally centrally located RF signal bridges 128 and 130 in the blocks 101 and 103 respectively which are each comprised of a bridge or island of dielectric material in each of the blocks 101 and 103 extending in a relationship and orientation generally normal to the longitudinal axis $L_1$ of each of the respective blocks 101 and 103 and electrically interconnecting the respective resonators 114, 116 and the resonators 118 and 120 in the respective blocks 101 and 103.

Specifically, the bridge 128 of dielectric material on the block 101 bridges and interconnects the dielectric material of the resonator 114 to the dielectric material of the resonator 116 while the bridge 130 of dielectric material on the block 103 bridges and interconnects the dielectric material of the resonator 118 to the dielectric material of the resonator 120.

In the embodiment shown, the width of each of the RF signal bridges or islands of dielectric material 128 and 130 is dependent upon the distance which the respective slots 124 and 126 extend into the respective blocks 101 and 103. In the embodiment shown, the respective slots 124 and 126 have a length greater than half the width of the respective blocks 101 and 103 and thus the respective RF signal transmission bridges 128 and 130 have a length less than half the width of the respective blocks 101 and 103.

Although not shown in any of the FIGURES, it is understood that the thickness or width or length of the slots 124 and 126 may be varied depending upon the particular application to allow the width and the length of the RF signal bridges 128 and 130 to be varied accordingly to allow control of the electrical coupling and bandwidth of the waveguide filter 100 and hence control the performance characteristics of the waveguide filter 100.

The blocks 101 and 103 additionally each comprise an electrical RF signal input/output electrode in the form of respective through-holes 146 extending through the body of the respective blocks 101 and 103 in a relationship generally normal to the longitudinal axis $L_1$ thereof and, more specifically, through the body of the respective end resonators 114 and 118 defined in the respective blocks 101 and 103 and terminating in respective apertures or holes 147 in the respective opposed horizontal top and bottom exterior surfaces 102 and 104 of the respective blocks 101 and 103. In the embodiment shown, the through-holes 146 are located at the same end of the respective blocks 101 and 103 in a relationship spaced from and generally centrally located along the respective transverse end exterior surface 110 of the respective blocks 101 and 103.

All of the external surfaces 102, 104, 106, 108, 110, and 112 of the blocks 101 and 103, the internal surfaces of the slots 124 and 126, and the internal surfaces of the input/output through-holes 146 are covered with a suitable conductive material, such as for example silver, with the exception of regions of the exterior surfaces as described in more detail below.

Specifically, in the embodiment shown, the exterior top horizontal surface 104 of each of the blocks 101 and 103 includes respective regions **400*a* and 402*a* which are devoid of conductive material and thus define regions 400*a* and 402*a* of dielectric material on the exterior top horizontal surface 104 of the respective blocks 101 and 103**.

As described below in more detail, the region **400*a* defines a means or window for the direct coupling and transmission of the RF signal from the block 101 into the block 201 when the block 201 is stacked on and coupled to the top of the block 101 as described in more detail below. In the embodiment shown, the region 400*a* is generally rectangular in shape, is located in the region of the respective resonators 116 and 120 in a relationship adjacent, spaced, and parallel to the transverse end exterior surface 112 of the respective blocks 101 and 103 and, still more specifically, in a relationship between and spaced from and parallel to the respective transverse end exterior surfaces 112 and the respective slots 124 and 126 in the respective blocks 101 and 103. In the embodiment shown, the region or window 400*a* is positioned generally centrally on the respective blocks 101 and 103** in a relationship intersecting and generally normal to the longitudinal axis $L_1$.

The region 402*a* is generally ring shaped and defines an isolated circular pad of conductive material 403*a* that defines a means for the cross or indirect coupling and transmission of the RF signal from the block 101 into the block 201 when the block 201 is stacked on and coupled to the top of the block 101 as described in more detail below. The region 402*a* and pad 403*a* are located in the region of the respective resonators 114 and 118 in a relationship between and spaced from the respective slots 124 and 126 and the respective through-holes 146 in the respective blocks 101 and 103. In the embodiment shown, the region or pad 402*a* is positioned generally centrally on the respective blocks 101 and 103 in a relationship intersecting the longitudinal axis $L_1$.

Still further, in the embodiment shown, the respective regions 400*a* and 402*a* are positioned co-linearly with respect to each other and are located on opposite sides of and spaced from the respective slots 124 and 126 on the respective blocks 101 and 103.

As shown in FIGS. 1 and 2, the blocks 101 and 103 are coupled and secured together in a relationship wherein: the vertical longitudinal exterior side surface 108 of the block 101 is abutted against and secured to the vertical longitudinal exterior side surface 106 of the block 103 to define an interior layer or strip of conductive material 500*a* extending between the respective blocks 101 and 103 in a relationship co-linear with the longitudinal axis $L_2$ of the coupled blocks 101 and 103; the respective horizontal exterior surfaces 102 and 104 of the respective blocks 101 and 103 are co-planarly aligned with each other; the respective vertical exterior end surfaces 106 and 108 of the respective blocks 101 and 103 are co-planarly aligned with each other; the respective slots 124 and 126 are co-linearly aligned with each other and face and open away from each other and are located on opposite sides of and spaced from and generally normal to the interior strip of conductive material 500*a* and longitudinal axis $L_2$; the respective regions 400*a* are co-linearly aligned with each other and located on opposite sides of and spaced from and generally normal to the interior strip of conductive material 500 and longitudinal axis $L_2$; and the respective regions 402*a* and pads 403*a* are co-linearly aligned with each other and located on opposite sides of and spaced from the interior strip of conductive material 500 and longitudinal axis $L_2$.

In a like manner, each of the top blocks 201 and 203 is comprised of a solid block of suitable dielectric material, such as for example ceramic; defines a longitudinal axis $L_1$; includes opposed longitudinal horizontal exterior top and bottom surfaces 202 and 204 extending longitudinally in the same direction as the longitudinal axis $L_1$; opposed longitudinal side vertical exterior surfaces 206 and 208 extending longitudinally in the same direction as the longitudinal axis $L_1$; and opposed transverse side vertical exterior end surfaces 210 and 212 extending in a direction generally normal to the longitudinal axis $L_1$ of each of the blocks 201 and 203.

Each of the blocks 201 and 203 includes a plurality of resonant sections (also referred to as cavities or cells or resonators) 214, 216 and 218, 220 respectively that are spaced and extend longitudinally along the length and longitudinal axis $L_1$ of the respective blocks 201 and 203 and are separated from each other by respective vertical slits or slots 224 and 226 which are cut into the surfaces 102, 104, 106, and 108 of each of the blocks 201 and 203 and respective RF signal bridges 128 and 132 of dielectric material as described in more detail below.

The slots 224 and 226 extend along the length of the respective side surfaces 106 and 108 of the respective blocks 201 and 203 in a relationship generally normal to the longitudinal axis $L_1$. Each of the slots 224 and 226 cuts through the respective side surfaces 106 and 108 and the opposed horizontal surfaces 102 and 104 and partially through the body and the dielectric material of each of the blocks 201 and 203. The slots 224 and 226 are generally centrally located in the respective blocks 201 and 203 between and in a relationship parallel to the opposed transverse exterior end surfaces 110 and 112.

In the embodiment shown, the slots 224 and 226 do not extend the full width of the respective blocks 201 and 203 and thus the blocks 201 and 203 define respective generally centrally located RF signal bridges 228 and 230 in the blocks 201 and 203 respectively which are each comprised of a bridge or island of dielectric material in each of the blocks 201 and 203 extending in a relationship and orientation generally normal to the longitudinal axis $L_1$ of each of the respective blocks 201 and 203 and electrically interconnecting the respective resonators 214, 216 and the resonators 218 and 220 in the respective blocks 201 and 203.

Specifically, the bridge 228 of dielectric material on the block 201 bridges and interconnects the dielectric material of the resonator 214 to the dielectric material of the resonator 216 while the bridge 230 of dielectric material on the block 203 bridges and interconnects the dielectric material of the resonator 218 to the dielectric material of the resonator 220.

In the embodiment shown, the width of each of the RF signal bridges or islands of dielectric material 228 and 230 is dependent upon the distance which the respective slots 224 and 226 extend into the respective blocks 201 and 203. In the embodiment shown, the respective slots 224 and 226 have a length greater than half the width of the respective blocks 201 and 203 and thus the respective RF signal transmission bridges 228 and 230 have a length less than half the width of the respective blocks 201 and 203.

Although not shown in any of the FIGURES, it is understood that the thickness or width or length of the slots 224 and 226 may be varied depending upon the particular application to allow the width and the length of the RF signal bridges 228 and 230 to be varied accordingly to allow control of the electrical coupling and bandwidth of the waveguide filter 100 and hence control the performance characteristics of the waveguide filter 100.

All of the external surfaces 202, 204, 206, 208, 210, and 212 of the blocks 201 and 203 and the internal surfaces of the slots 224 and 226 are covered with a suitable conductive material, such as for example silver, with the exception of regions of the exterior surface as described in more detail below.

Specifically, in the embodiment shown, the bottom exterior horizontal surface 202 of each of the blocks 201 and 203 includes respective regions 400*b* and 402*b* which are devoid of conductive material and thus define regions 400*b* and 402*b* of dielectric material on the bottom exterior horizontal surface 202 of the respective blocks 201 and 203.

As described below in more detail, the region 400*b* defines a means or window for the direct coupling and transmission of the RF signal between the blocks 101 and 201 when the block 201 is stacked on and coupled to the top of the block 101 as described in more detail below. In the embodiment shown, the region 400*b* is generally rectangular in shape, is located in the region of the respective resonators 216 and 220 in a relationship adjacent, spaced, and parallel to the transverse end exterior surface 212 of the respective blocks 201 and 203 and, still more specifically, in a relationship between and spaced from and parallel to the respective transverse end exterior surfaces 212 and the respective slots 224 and 226 in the respective blocks 201 and 203. In the embodiment shown, the region or window 400*b* is positioned generally centrally on the respective blocks 201 and 203 in a relationship intersecting and generally normal to the longitudinal axis $L_1$.

The region 402*b* is generally ring shaped and defines an isolated circular pad of conductive material 403*b* that defines a means for the cross or indirect coupling and transmission of the RF signal between the blocks 101 and 201 when the block 201 is stacked on and coupled to the top of the block 101 as described in more detail below. The region 402*b* and pad 403*b* are located in the region of the respective resonators 214 and 218 in a relationship between and spaced from the respective slots 224 and 226 and the respective transverse exterior end surfaces 110 of the respective blocks 201 and 203. In the embodiment shown, the region or pad 402*b* is positioned generally centrally on the respective blocks 201 and 203 in a relationship intersecting the longitudinal axis $L_1$.

Still further, in the embodiment shown, the respective regions 400*b* and 402*b* are positioned co-linearly with respect to each other and are located on opposite sides of and spaced from the respective slots 224 and 226 on the respective blocks 201 and 203.

The side vertical exterior surfaces 208 and 206 of the respective blocks 201 and 203 includes respective regions 600*a* and 600*b* which are devoid of conductive material and thus define respective regions 600*a* and 600*b* defining means or windows 600*a* and 600*b* for the direct coupling and transmission of the RF signal between the blocks 201 and 203 when the blocks 201 and 203 have been coupled together in a side-by-side relationship as described below.

In the embodiment shown, the regions or windows 600*a* and 600*b* are located on the respective regions of the blocks 201 and 203 defining the respective resonators 214 and 218 and the respective pads 402*b* and further in a co-linear relationship with the respective pads 402 and still further in a relationship opposed and spaced from the respective windows 400*b* defined on the respective opposed resonators 216 and 220 and separated by the respective slots 224 and 226.

As shown in FIGS. 1 and 2, the blocks 201 and 203 are coupled and secured together in a relationship wherein: the vertical longitudinal exterior side surface 208 of the block 201 is abutted against and secured to the vertical longitudinal exterior side surface 206 of the block 203 so as to define an interior layer or strip of conductive material 500*b* extending between the respective blocks 201 and 203 in a relationship co-linear with the longitudinal axis $L_2$ of the coupled blocks 201 and 203; the respective regions or windows 600*a* and 600*b* on the respective exterior side surfaces 208 and 206 are aligned and abutted against each other; the respective exterior horizontal surfaces 202 and 204 of the respective blocks 201 and 203 are co-planarly aligned with each other; the respective vertical exterior end surfaces 206 and 208 of the respective blocks 201 and 203 are co-planarly aligned with each other; the respective slots 224 and 226 are co-linearly aligned with each other and face and open towards each other and are located on opposite sides of and in a relationship generally normal to and terminating in the interior strip of conductive material 500*b* and longitudinal axis $L_2$; the respective regions 400*b* are co-linearly aligned with each other and located on opposite sides of and spaced from and generally normal to the interior strip of conductive material 500*b* and longitudinal axis $L_2$; and the respective regions 402*b* and pads 403*b* are co-linearly aligned with each other and located on opposite sides of and spaced from the interior strip or layer of conductive material 500*b* and longitudinal axis $L_2$.

In turn, the bottom blocks 101 and 103 and the top blocks 201 and 203 are stacked relative to each other in a relationship wherein: the bottom exterior horizontal surfaces 202 of the respective blocks 201 and 203 are abutted against the top exterior horizontal surfaces 104 of the bottom blocks 101 and 103 define an interior strip or layer of conductive material 500*c* located between the blocks 101 and 103 and the blocks 201 and 203 and extending in a relationship normal to and intersecting with the interior layer or strips 500*a* and 500*b*; the respective regions 400*b*, 402*b*, and pads 403*b* on the respective blocks 201 and 203 are aligned with and abutted against the respective regions 400*a*, 402*a*, and pads 403*a* on the respective blocks 101 and 103; and the respective exterior vertical side and end surfaces 206, 208, and 212 of the respective blocks 201 and 203 are co-planarly aligned with the respective exterior vertical side and end surfaces 106, 108, and 112 of the respective blocks 101 and 103 defining and forming an elongated step at the end of the filter 100 that extends the full width of the filter 100.

In the embodiment shown, the top blocks 201 and 203 have the same length and are shorter in length than the bottom blocks 101 and 103 and thus in the embodiment shown, the vertical exterior end surfaces 210 of the respective blocks 201 and 203 are positioned in a relationship co-planarly aligned with the respective through-holes 146 in the respective blocks 101 and 103 and further in a relationship spaced from and generally parallel to the vertical exterior end surfaces 110 of the blocks 101 and 103.

In accordance with the invention, the waveguide filter 100 defines a first magnetic or inductive direct coupling RF signal transmission path or transmission line for RF signals generally designated by the arrows d in FIGS. 1 and 2 successively into and vertically upwardly through the through-hole 147 in the bottom block 101 where the through-hole 147 defines the RF signal input and then through horizontally through the resonator 114 of the block 101 and in a direction generally transverse to the direction of the longitudinal axis $L_2$; then horizontally into and through the resonator 116 in the block 101 via and through the RF signal bridge 128 in the block 101 in the same direction as the direction of the longitudinal axis $L_2$ and towards the back exterior end surface 112 of the block 101; then vertically upwardly into the resonator 216 of the top block 201 via and through the aligned internal RF signal transmission means or windows 400*a* and 400*b* defined in the interior layer of conductive material 500*c* that is located between the bottom block 101 and the top block 201 and in a direction transverse to the direction of the longitudinal axis $L_2$; then horizontally through the resonator 216 in the same direction of the longitudinal axis $L_1$ and towards the front exterior end surface 210 of the block 201; then horizontally from the resonator 216 in the block 201 into and through the resonator 214 in the block 201 via and through the RF signal bridge 228 that is defined in the interior layer of conductive material 500*b* located between the two blocks 201 and 203 in a direction transverse to the direction of the longitudinal axis $L_2$; then horizontally rearward through the resonator 218 in the same direction as the longitudinal axis $L_2$; then into and horizontally rearward through the resonator 220 in the block 201 via and through the RF signal bridge 230 that is located between the resonators 218 and 220; then vertically downwardly in a direction transverse to the direction of the longitudinal axis $L_2$ from the resonator 220 in the top block 203 into the resonator 120 in the bottom block 103 via and through the aligned interior direct RF signal transmission means or windows 400*a* and 400*b* defined in the interior layer of conductive material 500*c* located between the top block 203 and the bottom block 103; then horizontally forwardly through the resonator 120 in the bottom block 103 in the same direction as the direction of the longitudinal axis $L_2$ and towards the through-hole 147; then horizontally forwardly into and through the resonator 118 in the bottom block 103 via and through the RF signal transmission bridge 130 located on the bottom block 103 between the resonators 120 and 118; and then vertically downwardly into and through the through-hole 147 defined in the bottom block 103 and in a direction transverse to the direction of the longitudinal axis $L_2$ where the through-hole 147 in the bottom block 103 defines the RF signal output of the waveguide filter 100.

Thus, in the embodiment shown, the RF signal travels through the waveguide filter 100 in a generally U-shaped pattern or path between the respective input/output through-holes 146 on the respective blocks 101 and 103 and still more specifically in a generally winding and serpentine U-shaped three-dimensional direct path through the waveguide fitter 100.

The waveguide filter 100 also defines and provides a pair of alternate or indirect- or cross-coupling RF signal transmission means or paths for RF signals generally designated by the arrows c in FIGS. 1 and 2.

One of the cross-coupling or indirect RF signal transmission paths c is defined and created by the pair of interior or internal RF signal transmission means or isolated conductive pads 403*a*, 403*b* that are located in the interior layer of conductive material 500*c* and allow for: the transmission of a small portion of the direct RF signal being transmitted through the resonator 114 of the bottom block 101 upwardly into the resonator 214 of the top block 201 via and through the abutting conductive pads 403*a* and 403*b* in a direction transverse to the direction of the longitudinal axis $L_2$; and also the transmission of a small portion of the direct RF signal being transmitted through the resonator 218 of the top block 203 downwardly into the resonator 118 of the bottom block 103 via and through the abutting conductive pads 403*a* and 403*b* in a direction transverse to the direction of the longitudinal axis $L_2$.

In accordance with the invention, the cross-coupling of the RF signal as described above advantageously creates respective first and second transmission zeros, the first of which will be located below the passband of the waveguide filter 100 and the second of which will be located above the passband of the waveguide filter 100.

While the invention has been taught with specific reference to the embodiments shown, it is understood that a person of ordinary skill in the art will recognize that changes can be made in form and detail without departing from the spirit and the scope of the invention. The described embodiments are to be considered in all respects only as illustrative and not restrictive.

I claim:

1. A waveguide filter for the transmission of an RF signal comprising:

a plurality of separate blocks of solid dielectric material with first and second ones of the plurality of separate blocks coupled together in a side-by-side relationship with respective exterior side surfaces thereof abutted against each other and with at least the first and a third one of the plurality of separate blocks abutted against each other in a stacked relationship with respective exterior top and bottom surfaces abutted against each other;

each of the plurality of separate blocks including one or more slots formed therein for defining a plurality of resonators in each of the blocks and the respective exterior top, bottom, and side surfaces thereof being covered with a layer of conductive material and defining internal layers of conductive material between the side-by-side and stacked plurality of blocks of dielectric material;

first regions in the internal layers of conductive material devoid of conductive material and defining first internal windows for a direct transmission of the RF signal between the plurality of resonators in the side-by-side and stacked plurality of separate blocks of dielectric material; and second regions in the internal layers of conductive material devoid of conductive material and defining second internal means for an indirect transmission of the RF signal between the plurality of resonators in the stacked plurality of separate blocks of dielectric material.

2. A waveguide filter for the transmission of an RF signal comprising:

a plurality of separate blocks of solid dielectric material coupled together in a combined side-by-side and stacked relationship, at least first and second ones of the plurality of separate blocks are coupled in a side-by-side relationship with respective exterior side surfaces thereof abutted against each other and at least the first and a third one of the plurality of blocks are abutted against each other in a stacked relationship with respective exterior top and bottom surfaces abutted against each other, each of the exterior top, bottom, and side surfaces being covered with a layer of conductive material and defining a plurality of resonators;

each of the plurality of separate blocks including one or more slots formed in the solid dielectric material and defining the plurality of resonators in each of the blocks;

a first internal layer of conductive material defined between each of the side-by-side plurality of separate blocks of dielectric material by the layer of conductive material covering the exterior surface of each of the plurality of separate blocks of dielectric material;

a second internal layer of conductive material defined between each of the stacked plurality of blocks of dielectric material by the layer of conductive material covering the exterior surface of each of the plurality of blocks of dielectric material;

an RF signal input defined on the first one of the plurality of blocks of dielectric material;

an RF signal output defined on the second one of the plurality of blocks of dielectric material, the RF signal being transmitted through the plurality of resonators in the plurality of blocks of dielectric material between the RF signal input and the RF signal output;

internal direct RF signal transmission means defined in selected regions of the first and second internal layers of conductive material for a direct transmission of the RF signal between a resonator in one of the plurality of blocks of dielectric material and a resonator in another of the plurality of blocks of dielectric material; and internal indirect RF signal transmission means defined in selected regions of the first internal layer of conductive material for an indirect transmission of the RF signal between a resonator in one of the plurality of blocks of dielectric material and a resonator in another of the plurality of separate blocks of dielectric material.

3. The waveguide filter of claim 2 wherein each of the RF signal input and output is defined by an RF signal transmission through-hole extending through respective first and second ones of the plurality of blocks of dielectric material, and the internal indirect RF signal transmission means is an isolated pad of conductive material in the interior layer of conductive material.

4. A waveguide filter for the transmission of an RF signal comprising:

a plurality of blocks of dielectric material coupled together in a combined side-by-side and stacked relationship, each of the plurality of blocks of dielectric material including an exterior surface covered with a layer of conductive material and defining a plurality of resonators;

a first internal layer of conductive material defined between each of the side-by-side plurality of blocks of dielectric material by the layer of conductive material covering the exterior surface of each of the plurality of blocks of dielectric material;

a second internal layer of conductive material defined between each of the stacked plurality of blocks of dielectric material by the layer of conductive material covering the exterior surface of each of the plurality of blocks of dielectric material;

an RF signal input defined on a first one of the plurality of blocks of dielectric material;

an RF signal output defined on a second one of the plurality of blocks of dielectric material, the RF signal being transmitted through the plurality of resonators in the plurality of blocks of dielectric material between the RF signal input and the RF signal output;

internal direct RF signal transmission means defined in selected regions of the first and second internal layers of conductive material for a direct transmission of the RF signal between a resonator in one of the plurality of blocks of dielectric material and a resonator in another of the plurality of blocks of dielectric material; and internal indirect RF signal transmission means defined in selected regions of the first internal layer of conductive material for an indirect transmission of the RF signal between a resonator in one of the plurality of blocks of dielectric material and a resonator in another of the plurality of blocks of dielectric material, the internal direct RF signal transmission means being defined by a window in the first and second internal layers of conductive material devoid of conductive material and the internal indirect RF signal transmission means is defined by an isolated pad of conductive material defined in the first internal layer of conductive material.

5. The waveguide filter of claim 4 wherein the plurality of blocks of dielectric material comprise first and second blocks of dielectric material coupled together in a side-by-side relationship and third and fourth blocks of dielectric material coupled together in a side-by-side relationship, the first and second blocks of dielectric material being coupled to the third and fourth blocks in a stacked relationship, the RF signal input and the RF signal output being defined in the first and second blocks of dielectric material respectively, the internal direct RF signal transmission means defined by a first interior window defined between the first and third blocks of dielectric material, a second interior window defined between the third and fourth blocks of dielectric material, and a third interior window defined between the fourth and second blocks of dielectric material, and the internal indirect RF signal transmission means is defined by a first internal isolated pad of conductive material between the first and third blocks of dielectric material and a second internal isolated pad of conductive material between the second and fourth blocks of dielectric material.

6. A waveguide filter for the transmission of an RF signal comprising:

a plurality of blocks of dielectric material coupled together in a side-by-side and stacked relationship;

each of the blocks defining resonators and including an exterior surface covered with a layer of conductive material and defining internal layers of conductive material between the side-by-side and stacked plurality of blocks of dielectric material;

first regions in the internal layers of conductive material devoid of conductive material and defining first internal windows for a direct transmission of the RF signal between the resonators in the side-by-side and stacked plurality of blocks of dielectric material; and second regions in the internal layers of conductive material devoid of conductive material and defining second internal means for an indirect transmission of the RF signal between the resonators in the stacked plurality of blocks of dielectric material, the second internal means for the indirect transmission of the RF signal comprising isolated pads of conductive material in the internal layers of conductive material.

7. A waveguide filter for the transmission of an RF signal comprising:

first and second blocks of dielectric material coupled together in a side-by-side relationship, each of the first and second blocks of dielectric material defining a plurality of resonators and including an exterior surface covered with a layer of conductive material;

third and fourth blocks of dielectric material coupled together in a side-by-side relationship, each of the third and fourth blocks of dielectric material defining a plurality of resonators and including an exterior surface covered with a layer of conductive material, the first and second blocks of dielectric material and the third and fourth blocks of dielectric material being coupled relative to each other in a stacked relationship;

a first interior layer of conductive material defined between the first and second blocks of dielectric material and the third and fourth blocks of dielectric material by the layer of conductive material covering the first, second, third, and fourth blocks of dielectric material;

a second interior layer of conductive material defined between the first and third blocks of dielectric material and the second and fourth blocks of dielectric material by the layer of conductive material covering the first, second, third, and fourth blocks of dielectric material;

an RF signal input transmission through-hole defined in the first block of dielectric material;

an RF signal output transmission through-hole defined in the second block of dielectric material, the RF signal being transmitted through the plurality of resonators in the first, second, third, and fourth blocks of dielectric material between the RF signal input transmission through-hole and the RF signal output transmission through-hole;

a first internal direct RF signal transmission window between the first and third blocks of dielectric material and defined by a first region in the first interior layer of conductive material that is devoid of conductive material for a direct transmission of the RF signal between one of the plurality of resonators in the first block of dielectric material and one of the plurality of resonators in the third block of dielectric material;

a second internal direct RF signal transmission window between the second and fourth blocks of dielectric material and defined by a second region in the first interior layer of conductive material that is devoid of conductive material for a direct transmission of the RF signal between one of the plurality of resonators in the fourth block of dielectric material and one of the plurality of resonators in the second block of dielectric material;

a third internal direct RF signal transmission window between the third and fourth blocks of dielectric material and defined by a first region in the second interior layer of conductive material for a direct transmission of the RF signal between one of the plurality of resonators in the third block of dielectric material and one of the resonators in the fourth block of dielectric material;

a first internal indirect RF signal transmission means between the first and third blocks of dielectric material and defined by a third region in the first interior layer of conductive material that is devoid of conductive material for an indirect transmission of the RF signal between another of the plurality of resonators in the first block of dielectric material and another of the plurality of resonators in the third block of dielectric material; and a second internal indirect RF signal transmission means between the second and fourth blocks of dielectric material and defined by a fourth region in the first interior layer of conductive material that is devoid of conductive material for an indirect transmission of the RF signal between another of the plurality of resonators in the fourth block of dielectric material and another of the plurality of resonators in the second block of dielectric material.

8. The waveguide filter of claim 7 wherein the first and second internal indirect RF signal transmission means comprise first and second isolated pads of conductive material defined by the third and fourth regions in the first interior layer of conductive material.

9. The waveguide filter of claim 7 wherein the plurality of resonators in each of the first, second, third, and fourth blocks of dielectric material are separated by a slit and an RF signal transmission bridge.

10. The waveguide filter of claim 9 wherein the slit defined in the third block of dielectric material faces the slit defined in the fourth block of dielectric material and the slit defined in the first block of dielectric material faces away from the slit defined in the second block of dielectric material.

* * * * *